US012571190B2

(12) United States Patent
Song

(10) Patent No.: US 12,571,190 B2
(45) Date of Patent: Mar. 10, 2026

(54) TOUCHLESS BATH FAUCET

(71) Applicant: AS America, Inc., Piscataway, NJ (US)

(72) Inventor: Ki Bok Song, Plainview, NY (US)

(73) Assignee: AS America, Inc., Piscataway, NJ (US)

( * ) Notice: Subject to any disclaimer, the term of this patent is extended or adjusted under 35 U.S.C. 154(b) by 133 days.

(21) Appl. No.: 18/377,528

(22) Filed: Oct. 6, 2023

(65) Prior Publication Data

US 2024/0117616 A1 Apr. 11, 2024

Related U.S. Application Data

(60) Provisional application No. 63/414,038, filed on Oct. 7, 2022.

(51) Int. Cl.
*E03C 1/05* (2006.01)
*E03C 1/02* (2006.01)
*E03C 1/04* (2006.01)

(52) U.S. Cl.
CPC ..... *E03C 1/057* (2013.01); *E03C 1/0404* (2013.01); *E03C 2001/026* (2013.01); *E03C 2001/0418* (2013.01)

(58) Field of Classification Search
CPC ..... E03C 1/057
See application file for complete search history.

(56) References Cited

U.S. PATENT DOCUMENTS 8,316,883 B1 * 11/2012 Watson ..... E03C 1/0404 137/551
9,062,790 B2 6/2015 Esche et al.
9,074,698 B2 7/2015 Esche et al.
9,341,278 B2 5/2016 Esche
9,695,580 B2 7/2017 Esche et al.
9,783,964 B2 * 10/2017 Thompson ..... G05B 15/02
9,822,902 B2 11/2017 Esche et al.
9,945,103 B2 4/2018 Thompson et al.
10,260,653 B2 4/2019 Esche et al.
10,273,669 B2 4/2019 Esche et al.
10,301,799 B2 5/2019 Thompson et al.
10,323,393 B2 6/2019 Thompson et al.
10,458,565 B2 10/2019 Esche
2010/0108165 A1 * 5/2010 Rodenbeck ..... E03C 1/057 137/801
2011/0186154 A1 * 8/2011 Klicpera ..... E03C 1/055 137/551
2014/0053906 A1 2/2014 Esche et al.
2014/0053925 A1 2/2014 Esche et al.
2014/0054478 A1 2/2014 Esche
(Continued)

FOREIGN PATENT DOCUMENTS

EP 2700757 A2 2/2014
EP 2700854 A2 2/2014
(Continued)

*Primary Examiner* — Christine J Skubinna

(74) *Attorney, Agent, or Firm* — Anna-Lisa L. Gallo; Tyler A. Stevenson

(57) ABSTRACT

An automatic faucet assembly comprising a presence sensor and a temperature control assembly. A temperature control assembly may be coupled to a faucet body. An automatic faucet may comprise a digital display surface configured to display dispensed water temperature in real time and dispensed water time. A display surface may display steps for proper handwashing.

21 Claims, 4 Drawing Sheets

(56) References Cited

U.S. PATENT DOCUMENTS

| | | | | |
|---|---|---|---|---|
| 2015/0240462 | A1 | 8/2015 | Esche et al. | |
| 2015/0308084 | A1 | 10/2015 | Thompson et al. | |
| 2015/0308089 | A1 | 10/2015 | Thompson et al. | |
| 2015/0308587 | A1 | 10/2015 | Esche et al. | |
| 2016/0238152 | A1 | 8/2016 | Esche | |
| 2016/0258144 | A1* | 9/2016 | Tayenaka | G05D 27/02 |
| 2017/0275861 | A1 | 9/2017 | Esche et al. | |
| 2018/0002904 | A1 | 1/2018 | Thompson et al. | |
| 2018/0038510 | A1 | 2/2018 | Esche et al. | |
| 2018/0187399 | A1 | 7/2018 | Thompson et al. | |
| 2019/0264428 | A1* | 8/2019 | Casey | E03C 1/057 |
| 2020/0123747 | A1* | 4/2020 | Frackelton | E03C 1/057 |
| 2020/0299941 | A1* | 9/2020 | Veros | G05D 7/0635 |
| 2021/0388585 | A1* | 12/2021 | Hamilton | E03C 1/057 |

FOREIGN PATENT DOCUMENTS

| | | | |
|---|---|---|---|
| EP | 2700856 | A2 | 2/2014 |
| EP | 2937478 | A1 | 10/2015 |
| EP | 2937760 | A1 | 10/2015 |
| EP | 2700854 | B1 | 5/2020 |
| EP | 2700856 | B1 | 8/2020 |
| GB | 2353851 | B | 12/2002 |

* cited by examiner

TOUCHLESS BATH FAUCET

The disclosure is directed to a bath faucet, in particular to a touchless, or "hands-free", faucet having temperature control.

BACKGROUND

Automatic hands-free or "touchless" faucets are employed in many settings, for instance in bathrooms of office buildings, restaurants, airports, hospitals, and other settings. Automatic faucets may employ infrared or capacitive proximity sensors to determine the presence of a person desirous of washing their hands. Typically, a sensor is configured to detect the presence of a person's hands, such that upon detection, a valve is opened to allow for water for a specified time period.

In order to reduce a number of contamination "touch-points", desired also are automatic touchless faucets for use in residential settings. Also desired is an automatic faucet for residential or commercial bath settings that easily detects a person desirous of operating the faucet and delivering a desired amount of water, while minimizing wasted energy and/or water.

A temperature of water delivered from an automatic faucet is generally pre-set, with a person using a faucet not knowing the temperature setting, and often using cold water until it warms up. Also desired is an automatic faucet which delivers water at a desired temperature.

Also, it is recommended when washing one's hands, to scrub hands with soap and water for 20 seconds, followed by rinsing with water. Desired is a faucet system configured to indicate when a person has properly washed their hands.

SUMMARY

Accordingly, disclosed is an automatic faucet assembly, comprising a faucet body; a faucet spout; a temperature control assembly; an electromechanical valve; a power source; and a controller, wherein the faucet body and/or faucet spout comprise a presence sensor configured to detect a presence and an absence of a person's hand at or near the faucet body and/or faucet spout, the controller is configured to receive a presence signal from the presence sensor indicating the presence of a person's hand at or near the faucet body and/or faucet spout, and is configured to receive an absence signal from the presence sensor indicating the absence of a person's hand at or near the faucet body and/or faucet spout, the controller is configured to instruct the electromechanical valve to open upon receiving the presence signal, and is configured to instruct the electromechanical valve to close upon receiving the absence signal, the faucet assembly is configured to dispense water when the electromechanical valve is open and is configured to not dispense water when the electromechanical valve is closed, and a temperature of the dispensed water may be adjusted by operation of the temperature control actuator.

BRIEF DESCRIPTION OF THE DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION

Figure 1A:
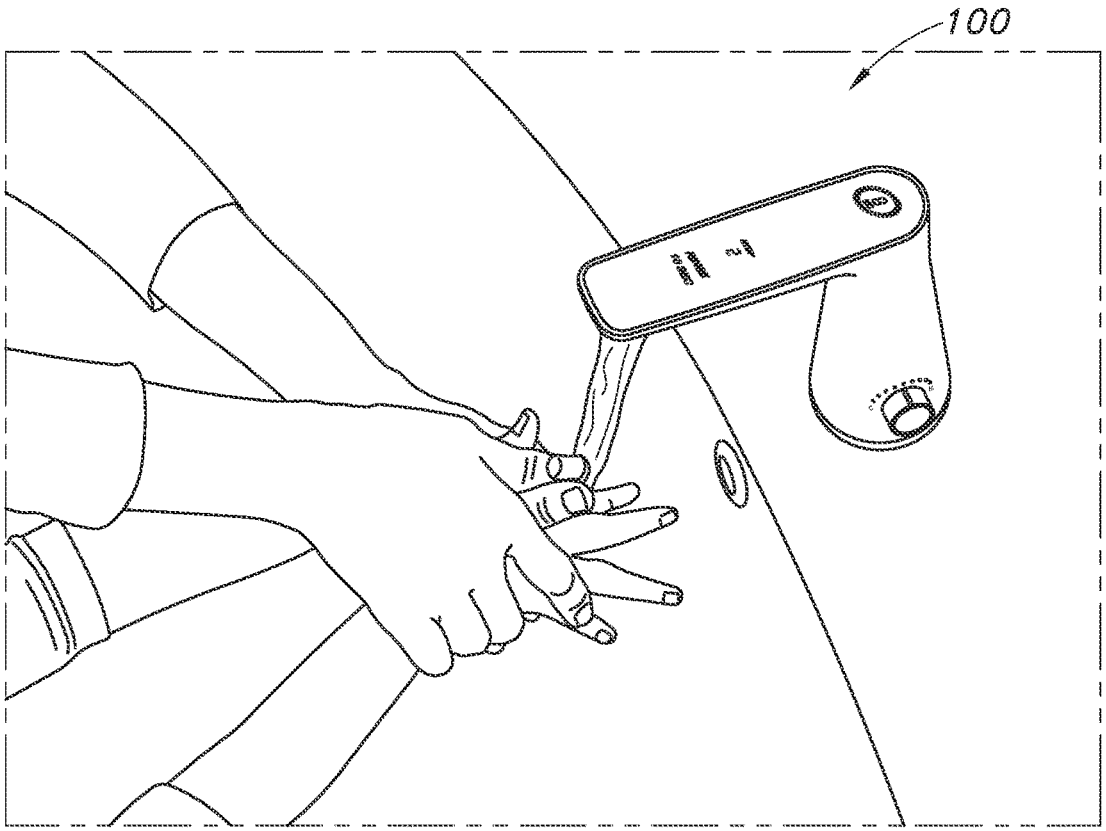
FIG. 1A and FIG. 1B provide views of an automatic faucet according to an embodiment.
Figure 1B:
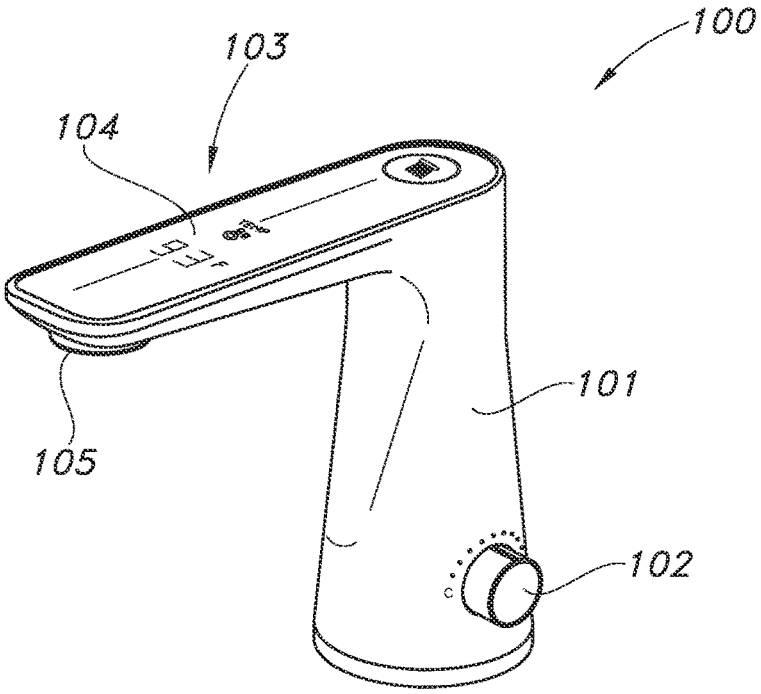

FIG. 1A and FIG. 1B show automatic faucet assembly 100, according to an embodiment. FIG. 1A shows assembly 100 dispensing a water stream during handwashing. Faucet assembly 100 comprises rotating temperature control assembly knob 102 positioned on faucet body 101. Temperature control knob 102 is configured to be rotated clockwise for a warmer water setting. Faucet spout 103 comprises LED display surface 104 and water outlet 105. Display surface 104 is configured to show various features including water temperature, faucet mode, water delivery time, handwashing steps, etc.

Figure 1C:
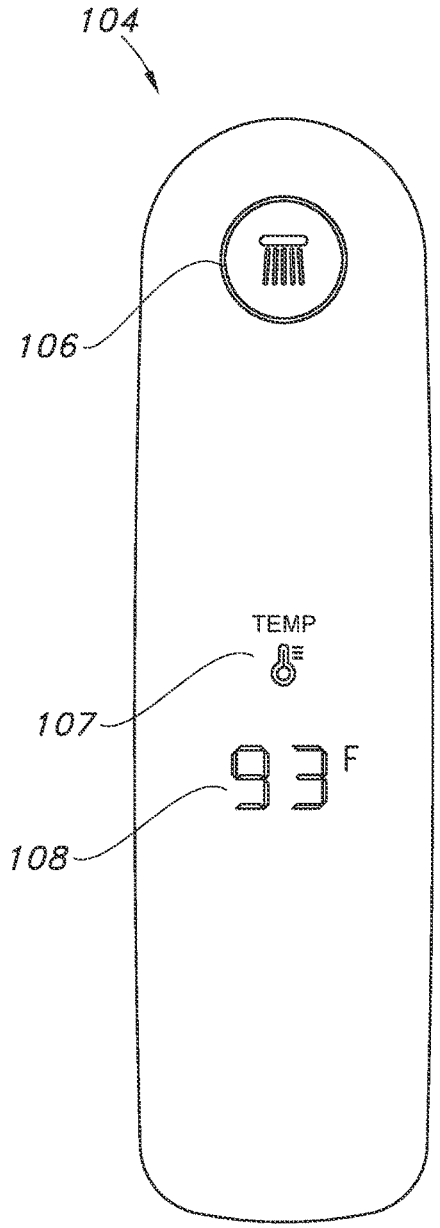
FIG. 1C, FIG. 1D, FIG. 1E, and FIG. 1F show views of a display surface of an automatic faucet, according to some embodiments.

FIG. 1C, FIG. 1D, FIG. 1E, and FIG. 1F provide top views of display surface 104, according to some embodiments. First region 106 shows an operation mode of faucet 100. First region 106 comprises a capacitive touch sensor configured for one to toggle between different faucet modes. FIG. 1C shows faucet 100 is in a faucet spray mode. Other faucet modes may include a stream mode and a handwashing mode. A handwashing mode may include a handwashing/spray mode and a handwashing/stream mode. Display region 106 may include one or more icons. A person may bring a hand or finger near or on region 106 to select a faucet mode.

Figure 1D:
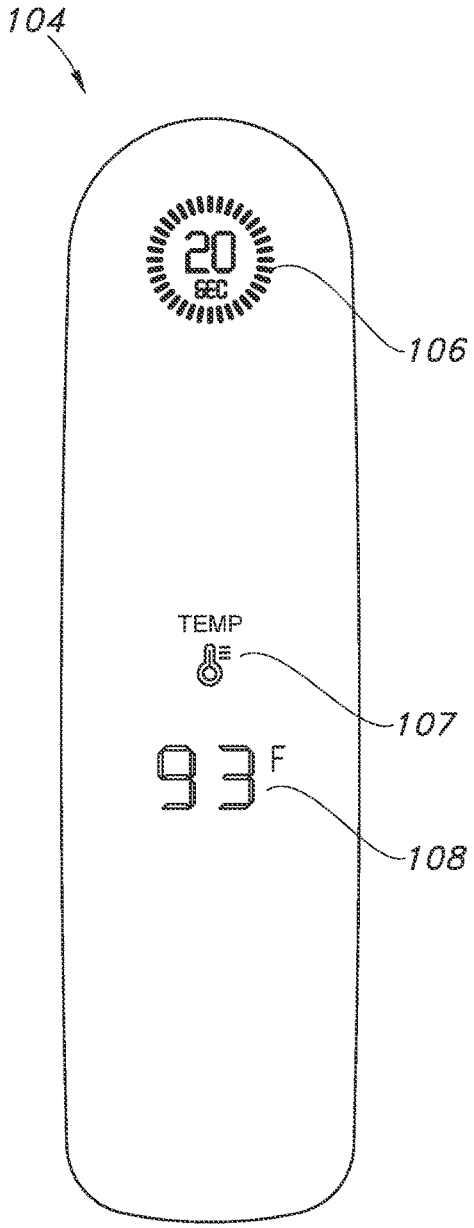
Figure 1E:
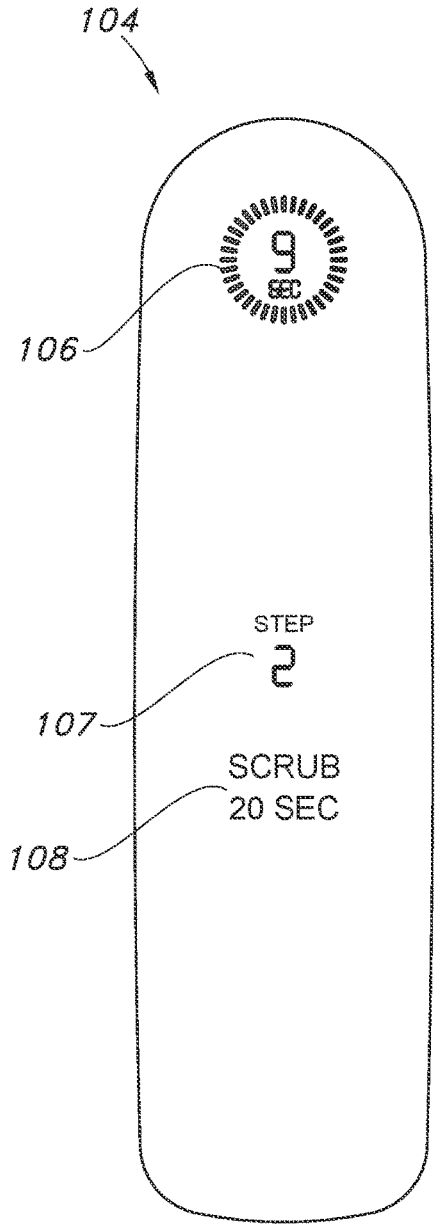
Figure 1F:
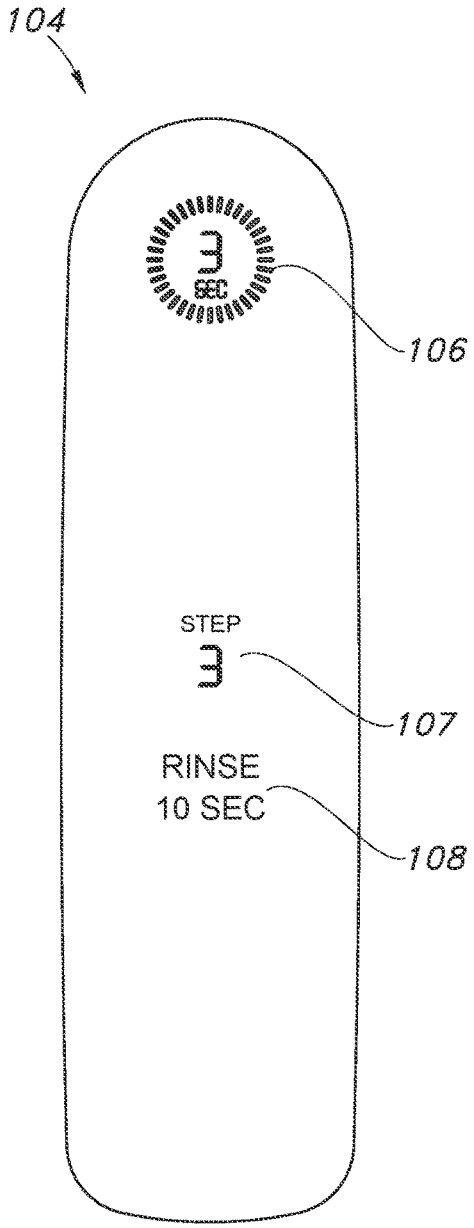

If a spray or a stream mode is selected, for example for brushing teeth or shaving, faucet 100 is configured to deliver water once a person brings a hand at or near body 101 and/or spout 103. Second region 108 in FIG. 1C indicates dispensed water temperature in real time as it reaches a set temperature, for example 100° F. for handwashing. Third region 107 in FIG. 1C indicates that water temperature is being displayed. Upon initiation of water flow, first region 106 is configured to indicate usage time, as seen in FIG. 1D. Indication of usage time will serve to remind a user to conserve water. Body 101 and/or spout 103 themselves are configured to act as a capacitive sensor. As a person places a hand at or near body 101 and/or spout 103, faucet 100 is directed to dispense water. When a person's hand or hands are not present at or near faucet 100, water will shut off. For example, with shaving, water will turn on when rinsing a blade, and will turn off during the act of shaving. In this way, for teeth brushing or shaving, automatic water and energy savings are provided with faucet 100.

Once a handwashing mode is selected and initiated, first region 106 is configured to display a water delivery mode (for example stream or spray), third region 107 is configured to display a temperature icon, and second region 108 is configured to display temperature of water delivered from outlet 105. According to guidelines, a person should first wet their hands with running water, apply soap, scrub hands with soap for at least about 20 seconds, and thoroughly rinse off soap. Once dispensed water reaches a desired temperature, for example 100° F., third region 107 will now display "STEP 1", second region 108 will display "WET HANDS", and first region 106 will display a timer. Faucet 100 is configured such that, as one wets their hands, and removes them to apply soap, water will shut off. Scrubbing hands with soap should at least be initiated at or near faucet 100 to again activate a timer. First region 106 is configured to show scrubbing time, second region 108 will indicate "SCRUB 20 SEC" and third region 107 will display "STEP 2". After one scrubs hands with soap for at least 20 seconds, one may place hands at or near faucet 100 to initiate water flow to deliver water flow for rinsing off soap and re-set the timer. Third region 107 is configured to indicate "STEP 3", and second region 108 is configured to indicate "RINSE 10 SEC", respectively, for a rinsing step.

Figure 2A:
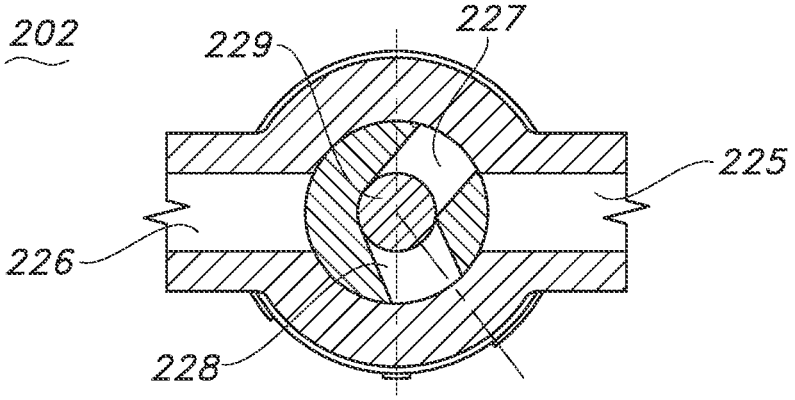
FIG. 2A, FIG. 2B, and FIG. 2C provide cross-section views of a temperature control assembly, according to some embodiments.
Figure 2B:
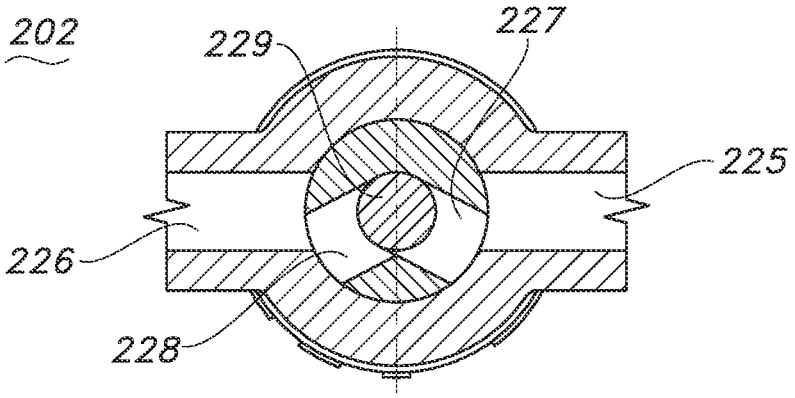
Figure 2C:
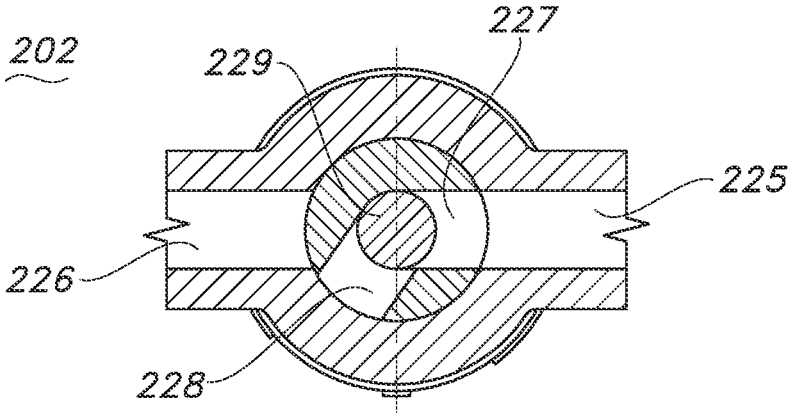

FIG. 2A, FIG. 2B, and FIG. 2C show cross-section interior views of temperature control assembly 202, according to some embodiments. Temperature control assembly 202 comprises cold water inlet 225, hot water inlet 226, and mixed hot/cold water outlet 229. Cold water inlet 225 is configured to be fluidly coupled to a cold water source line, hot water inlet 226 is configured to be fluidly coupled to a hot water source line, and mixed hot/cold water outlet 229 is configured to be fluidly coupled to a mixed hot/cold water supply line, and to deliver mixed hot/cold water to a faucet spout outlet. An electromechanical solenoid valve may be positioned in a mixed hot/cold water outlet line downstream of outlet 229 and upstream of a faucet spout outlet. An electromechanical solenoid valve may be positioned at an interior of a faucet body.

FIG. 2A shows a position of temperature control assembly 202 in an "off" position, with cold water rotatable outlet section 227 and hot water rotatable outlet section 228 both unaligned with cold water inlet 225 and hot water inlet 226. Accordingly, a temperature control assembly may be configured to "disable" an automatic faucet from delivering water if a person's hands are present at or near a faucet.

FIG. 2C shows a position of temperature control assembly 202 in a fully cold position as it is rotated clockwise from an "off" position to a "cold" position. Cold water inlet 225 is fully aligned with cold water rotatable outlet section 227 and hot water inlet 226 is unaligned with hot water rotatable outlet section 228. Outlet 229 will deliver only cold water in this position.

FIG. 2B shows an intermediate position of temperature control assembly 202 as it is further rotated in a clockwise position. Both cold water inlet 225 and hot water inlet 226 are partially aligned with rotatable cold water outlet section 227 and rotatable hot water outlet section 228, respectively. Outlet 229 is now in flow communication with both inlet 225 and inlet 226, and is configured to deliver mixed hot/cold water to a faucet spout. In some embodiments, a temperature control assembly may be configured such that it may not deliver fully hot water, e.g. where a hot water inlet is fully aligned with a rotatable hot water outlet section and a cold water inlet is unaligned with a rotatable cold water outlet section (an inverse of FIG. 2C). For instance, residential hot water heaters may be set at about 140° F. to kill bacteria. A temperature control assembly may be configured such that it may not deliver fully hot water, and must deliver a mixed hot/cold water, so that a maximum adjustable temperature setting is from about 115° F. to about 125° F.

An electromechanical valve, for instance a solenoid valve, a power source, a presence sensor, and a controller are in electrical communication. Electrical communication between a controller and an electromechanical valve and/or a sensor may be wired or wireless. A power source may comprise a secondary battery or a building AC power. A faucet body may be coupled to a countertop, a sink top, or a wall. In some embodiments, a controller may be positioned below a countertop or sink top. In some embodiments, a battery power source may be positioned below a countertop or sink top. In other embodiments, a controller or a battery power source may be positioned in a faucet body.

In some embodiments, a presence sensor may comprise an infrared (IR) sensor and/or a capacitive sensor. An IR sensor may require a "window" positioned on a faucet body. In some embodiments, a sensor comprises a capacitive sensor, wherein the faucet body comprises no window and has a continuous smooth surface. In some embodiments, a faucet assembly may comprise a first capacitive sensor and a second capacitive sensor. A first capacitive sensor may be positioned at a faucet body interior, and a second capacitive sensor may be positioned at a faucet spout interior. Only one of a first and a second capacitive sensor may need to be activated for a faucet assembly to be instructed to dispense water. In other embodiments, a first capacitive sensor and a second capacitive sensor may be positioned at a same or close location within a faucet assembly. In some embodiments, a first capacitive sensor may be configured to detect a person's hand at or near a faucet body and/or spout, and configured to relay this information to a controller, the controller configured to instruct an electromechanical valve to open or close in response. In some embodiments, a second capacitive sensor may be configured to detect a presence of a person at a sink associated with a faucet assembly, and configured to relay this information to a controller. A controller may be configured to instruct a timer or a series of handwashing steps to proceed accordingly.

As a person desirous of using water from a faucet brings a hand or hands at or near a faucet body and/or faucet spout, a capacitive sensor may be configured to detect a change in an electric field. A capacitive sensor is configured to send a signal to a controller to indicate the presence of a person's hand or hands. As used herein a person's "hand" may include a single hand or two hands. Upon receiving a signal from a sensor that a person's hand is at or near the faucet, the controller is configured to instruct an electromechanical valve to open, whereupon a water supply line will deliver water to a faucet outlet.

In some embodiments, a faucet body and/or faucet spout may comprise an electrically conductive material and may be in electrical communication with a power source, a controller, and an electromechanical valve. That is, a faucet body itself may be associated with an electric field and may itself serve as a capacitive sensor. In some embodiments, a faucet spout and faucet body may comprise dissimilar materials. For example, a faucet spout may comprise a conductive material and a faucet body may comprise an insulating material. In other embodiments, a faucet spout may comprise an insulating material and a faucet body may comprise a conductive material. In such embodiments, a faucet may comprise a coating so as to appear as one continuous solid part. In some embodiments, an entire faucet body and spout may comprise a single material, such as an electrically conductive material. In some embodiments, a faucet body and/or faucet spout and controller together may be considered as a capacitive sensor or a capacitive sensing system.

A faucet assembly is configured to operate in various faucet modes. Faucet modes may include a water stream mode, a water spray mode, a water-savings mode, and a handwashing mode. A handwashing mode may include sub-modes including a handwashing/stream mode and a handwashing/spray mode, as an individual may prefer to wash one's hands with a water stream or a water spray. A faucet outlet may comprise one or more outlets including a stream outlet and a spray outlet. A faucet outlet may be electrically coupled to a controller such that it may receive an instruction from the controller to move or rotate between a stream outlet and a spray outlet.

A faucet assembly is configured such that, as a person places a hand at or near a faucet body and/or faucet spout, water will begin dispensing from a faucet outlet. A faucet assembly is configured such that, as a person removes their hand from being at or near a faucet body and/or faucet spout, water will cease being dispensed from a faucet outlet.

A faucet assembly comprises a temperature control assembly. A temperature control assembly may be configured to be manually manipulated by a person to set a desired water temperature. A temperature control assembly may be coupled to a faucet body, and conveniently positioned on a side of a faucet body. A temperature control assembly may comprise rotatable knob, a dial, a sliding switch, or a lever. In some embodiments, a temperature control assembly may comprise an "off" position, such that a presence sensor is deactivated as a faucet will not dispense water as one places a hand at or near a faucet body and/faucet spout. A temperature control assembly may be adjusted, for example rotated or otherwise moved to adjust a mix of hot water and cold water so that a faucet dispenses mixed hot/cold water at a desired temperature.

In some embodiments, a temperature control assembly may be fluidly coupled to both a hot water inlet line and a cold water inlet line, and also to an outlet fluid supply line. A temperature control assembly may be configured to adjust a mixture of hot and cold water, and to deliver mixed hot/cold water to a faucet outlet. An electromechanical valve may be coupled to a fluid supply line and positioned at an interior of a faucet body, downstream of a temperature control assembly and upstream of a faucet outlet.

An "outlet fluid supply line" and "fluid supply line" may be interchangeable, and may refer to a fluid line configured to deliver hot/cold mixed water through a faucet body and faucet spout to a faucet outlet.

An electromechanical valve may be configured to be positioned in a closed position so that water is not dispensed from the faucet, or in a fully open position to wherein water is dispensed from the faucet. In some embodiments, a faucet assembly may be set in a water-savings mode, so that upon a controller instructing the electromechanical valve to open, it may only partially open, thereby lowering a water flow rate to provide water savings. A term "partially open" may mean in between fully open and a closed positions.

A present faucet assembly may comprise a display surface configured to indicate a dispensed water temperature and/or an elapsed time that water is being dispensed (dispensed water time). In this way, one may be reminded that water and energy are being used and to conserve.

A display surface may for instance comprise a top surface of a faucet spout section, in some embodiments a top, flat surface. A controller may be electrically coupled to a display surface. A temperature probe or temperature sensor may associated with a fluid supply line, for example positioned in a fluid supply line or on or in an electromechanical valve or on or in a temperature control assembly outlet. A temperature probe or temperature sensor may be electrically coupled to a controller. In this way, a controller may be configured to receive a water temperature signal from a temperature sensor, and to instruct a display surface to indicate the water temperature. A water temperature indication may be a digital LED display. A dispensed water temperature may be displayed in real time as mixed hot/cold water delivered to a faucet spout warms up to a desired set water temperature. A display surface may be configured to indicate that a set temperature (temperature set with a temperature control assembly) has been reached, for example by providing a solid light symbol or a flashing light symbol.

A controller may comprise a timer. A faucet assembly may comprise a flow meter or flow sensor associated with a fluid supply line and in electrical communication with a controller. A flow sensor may for example be positioned in a fluid supply line or on or in a temperature control assembly outlet. In this way, a controller may be configured to determine an elapsed time that water is being dispensed from a faucet outlet (a time that a flow sensor detects water flow). A controller may be configured to instruct a display surface to indicate a dispensed water time.

A faucet may comprise one or more buttons, switches, pressure sensors, or capacitive touch sensors, configured to be manipulated for one to toggle between faucet modes. In some embodiments, a faucet display surface may comprise a capacitive touch sensor configured to be touched or swiped in order to toggle between different faucet modes.

In some embodiments, a display surface may comprise a first region and a second region. In some embodiments, a display surface may comprise a first region, a second region, and a third region. A display surface first region may be configured to show a faucet mode. A first region may also comprise a capacitive touch sensor for one to toggle between different faucet modes. In other embodiments, a faucet mode indicator and a capacitive touch sensor may be in different display surface regions, for example with one in a first region and the other in a second region.

As mentioned above, a display surface may be configured to indicate a dispensed water temperature in real time. A display surface may also be configured to indicate a dispensed water time (elapsed time water is dispensed). Temperature and time indicators may be in a same display region or in different regions, for instance one may be displayed in a first display region and the other in a second display region. In some embodiments, a display surface may comprise a third display region. A third display region may indicate what is being displayed in a second display region, for example a third display region may show a thermometer icon as a second display region indicates dispensed water temperature.

In some embodiments, a faucet mode may include a handwashing mode. In operation during a handwashing mode, a display surface may indicate instructions for proper handwashing. In some embodiments, once a handwashing mode is selected and initiated, a first display region may be configured to display a water delivery mode (for example stream or spray), a third display region may be configured to display a temperature icon, and second display region may be configured to display the temperature of water delivered from a faucet outlet. According to handwashing guidelines, a person should first wet their hands with running water, apply soap, scrub hands with soap for at least about 20 seconds, and thoroughly rinse off soap. Once dispensed water reaches a desired temperature, for example 100° F., a third region may display "STEP 1", a second region may display "WET HANDS", and a first region may display a timer. A faucet may be configured such that, as one wets their hands, and removes them to apply soap, water will shut off. Scrubbing hands with soap should may be initiated at or near a faucet to re-set and activate a timer. In other embodiments, a second capacitive sensor may be configured to detect a person at a sink associated with a faucet assembly, and thus be configured to re-set a timer automatically. A first region may be configured to show scrubbing time (elapsed time), a second region may indicate "SCRUB 20 SEC" and a third region may display "STEP 2". After one scrubs hands with soap for at least 20 seconds, one may place hands at or near a faucet to initiate water flow for rinsing off soap and again re-set the timer. A third region may be configured to indicate "STEP 3", a second region may be configured to indicate "RINSE 10 SEC", and a first region may be configured to indicate elapsed time, respectively, for a rinsing step.

During use in a normal stream or spray mode, for example for brushing teeth or shaving, water may automatically shut off as one removes their hands from at or near a faucet for tooth-brushing or shaving. This automatic feature provides for water savings. Further, a total elapsed dispensed water time may be shown for each use, which may inform a person regarding total water usage. A faucet may be configured such that a first capacitive sensor is configured to detect when a person's hand or hand is at or near the faucet, and to relay this information to a controller for the controller to send an instruction to an electromechanical valve to open when a hand is detected and to close when a hand is not detected. A faucet may comprise a second capacitive sensor configured to detect if a person is at or near a sink, such that water may be off, but a faucet assembly may detect that a person remains at a sink. In this way, a timer may be instructed to stop and start to show a total elapsed water delivery time for a usage, and not re-set each time a hand is removed from at or near the faucet.

In some embodiments, displays (indicators) of a display region may be with a light emitting diode (LED) light array. In some embodiments, a display surface may comprise a flexible support, a lens, and a printed circuit board, upon which a plurality of capacitive touch sensors and a plurality of lights may be disposed. In some embodiments, a printed circuit board positioned within a display surface assembly may comprise a "controller" as described herein.

Following are some non-limiting embodiments of the disclosure.

In a first embodiment, disclosed is an automatic faucet assembly, comprising a faucet body; a faucet spout; a temperature control assembly; an electromechanical valve; a presence sensor; a power source; and a controller, wherein the presence sensor is configured to detect a presence and an absence of a person's hand at or near the faucet body and/or faucet spout, the controller is configured to receive a presence signal from the presence sensor indicating the presence of a person's hand at or near the faucet body and/or faucet spout, and is configured to receive an absence signal from the presence sensor indicating the absence of a person's hand at or near the faucet body and/or faucet spout, the controller is configured to instruct the electromechanical valve to open upon receiving the presence signal, and is configured to instruct the electromechanical valve to close upon receiving the absence signal, the faucet assembly is configured to dispense water when the electromechanical valve is open and is configured to not dispense water when the electromechanical valve is closed, and a temperature of the dispensed water may be adjusted by operation of the temperature control actuator.

In a second embodiment, disclosed is a faucet assembly according to embodiment 1, wherein the presence sensor comprises a capacitive sensor. In a third embodiment, disclosed is a faucet assembly according to embodiments 1 or 2, wherein the presence sensor comprises a first capacitive sensor and a second capacitive sensor. In a fourth embodiment, disclosed is a faucet assembly according to embodiment 3, wherein the first capacitive sensor is configured to detect a presence and an absence of a person's hand at or near the faucet body and/or faucet spout, and the second capacitive sensor is configured to detect a presence and an absence of a person at or near a sink associated with the faucet assembly.

In a fifth embodiment, disclosed is a faucet assembly according to any of the preceding embodiments, wherein the temperature control assembly is coupled to the faucet body. In a sixth embodiment, disclosed is a faucet assembly according to any of the preceding embodiments, wherein the temperature control assembly comprises a rotatable knob, a dial, a sliding switch, or a lever. In a seventh embodiment, disclosed is a faucet assembly according to any of the preceding embodiments, wherein the temperature control assembly is coupled to and configured to be in flow communication with a hot water source and a cold water source.

In an eighth embodiment, disclosed is a faucet assembly according to any of the preceding embodiments, wherein the temperature control assembly comprises an off position configured to disallow the faucet assembly to dispense water. In a ninth embodiment, disclosed is a faucet assembly according to any of the preceding embodiments, wherein the temperature control assembly is configured such that a maximum adjustable temperature setting is from about 115° F. to about 125° F. In a tenth embodiment, disclosed is a faucet assembly according to any of the preceding embodiments, wherein the temperature control assembly comprises a cold water inlet, a hot water inlet, and a mixed hot/cold water outlet.

In an eleventh embodiment, disclosed is a faucet assembly according to any of the preceding embodiments, wherein the electromechanical valve is coupled to a mixed hot/cold water supply line and is positioned downstream of the temperature control assembly.

In a twelfth embodiment, disclosed is a faucet assembly according to any of the preceding embodiments, wherein the faucet spout comprises a display surface configured to display dispensed water temperature. In a thirteenth embodiment, disclosed is a faucet assembly according to any of the preceding embodiments, wherein the faucet spout comprises a display surface configured to display dispensed water temperature in real time as the temperature reaches a temperature set with the temperature control assembly.

In a fourteenth embodiment, disclosed is a faucet assembly according to any of the preceding embodiments, wherein the faucet spout comprises a display surface configured to display dispensed water time.

In a fifteenth embodiment, disclosed is a faucet assembly according to any of the preceding embodiments, comprising a temperature sensor associated with an outlet fluid supply line and in electrical communication with the controller. In a sixteenth embodiment, disclosed is a faucet assembly according to any of the preceding embodiments, comprising a flow sensor associated with an outlet fluid supply line and in electrical communication with the controller.

In a seventeenth embodiment, disclosed is a faucet assembly according to any of the preceding embodiments, wherein the faucet spout comprises a capacitive touch sensor configured to be operated for choosing a faucet mode. In an eighteenth embodiment, disclosed is a faucet assembly according to any of the preceding embodiments, wherein the faucet assembly is configured to operate in a faucet mode selected from one or more of a spray mode, a stream mode, a water-savings mode, and a handwashing mode.

In a nineteenth embodiment, disclosed is a faucet assembly according to embodiments 17 or 18, wherein the faucet spout comprises a display surface comprising a first region and a second region, and one of the first region and the second region comprises the capacitive touch sensor. In a twentieth embodiment, disclosed is a faucet assembly according to any of embodiments 17 to 19, wherein the faucet spout comprises a display surface comprising a first region and a second region, and one of the first region and the second region are configured to indicate the faucet mode.

In a twenty-first embodiment, disclosed is a faucet assembly according to any of the preceding embodiments, wherein the faucet spout comprises a display surface comprising a first region and a second region, and one of the first region and the second region is configured to indicate a dispensed water time, and the other of the first region and the second region is configured to indicate a dispensed water temperature. In a twenty-second embodiment, disclosed is a faucet assembly according to embodiments 20 or 21, wherein the first region is configured to indicate a dispensed water time and/or the faucet mode.

In a twenty-third embodiment, disclosed is a faucet assembly according to any of the preceding embodiments, wherein the faucet spout comprises a display surface comprising a first region, a second region, and a third region, and the third region is configured to display an icon indicating what is being displayed in the second region.

In a twenty-fourth embodiment, disclosed is a faucet assembly according to any of the preceding embodiments, wherein the faucet spout comprises a display surface comprising a first region and a second region, the first region is configured to indicate a faucet mode and/or elapsed time, and the second region is configured to indicate a dispensed water temperature and/or a function a person is to perform in the faucet mode. In a twenty-fifth embodiment, disclosed is a faucet assembly according to embodiment 24, wherein the faucet mode is a handwashing mode, the first region is configured to indicate a water spray mode or a water stream mode, and the second region is configured to indicate the dispensed water temperature.

In a twenty-sixth embodiment, disclosed is a faucet assembly according to embodiment 25, wherein the function is a handwashing first step comprising a wetting of the person's hands. In a twenty-seventh embodiment, disclosed is a faucet assembly according to any of embodiments 24 to 26, wherein the faucet mode is a handwashing mode, the first region is configured to indicate when 20 seconds have elapsed, and the function is a handwashing second step comprising soap scrubbing of the person's hands. In a twenty-eighth embodiment, disclosed is a faucet assembly according to any of embodiments 24 to 27, wherein the faucet mode is a handwashing mode, the first region is configured to indicate when 10 seconds have elapsed, and the function is a handwashing third step comprising rinsing of the person's hands.

In a twenty-ninth embodiment, disclosed is a faucet assembly according to any of the preceding embodiments, wherein the faucet assembly is configured to operate in a water-savings mode, the electromechanical valve is configured to be positioned in a partially-opened position, and the flow rate of dispensed water is less than that when the electromechanical valve is in a fully-opened position.

In a thirtieth embodiment, disclosed is a faucet assembly according to any of the preceding embodiments, wherein the faucet body and/or faucet spout comprise an electrically conductive material and are/is configured to be associated with an electric field, the faucet body and/or faucet spout, the controller, the electromechanical valve, and the power source are in electrical communication, the controller is configured to receive a presence signal from the faucet body and/or faucet spout indicating the presence of a person's hand in the electric field, and the controller is configured to receive an absence signal from the faucet body and/or faucet spout indicating the absence of a person's hand in the electric field.

The term "flow communication" or "fluid communication" means for example configured for liquid or gas flow there-through and may be synonymous with "fluidly coupled". The terms "upstream" and "downstream" indicate a direction of gas or fluid flow, that is, gas or fluid will flow from upstream to downstream.

Likewise, "electrical communication" may mean "electrically coupled". Electrical communication may be via wired connection or may be wireless.

The terms "coupled" or "connected" may mean that an element is "attached to" or "associated with" another element. Coupled or connected may mean directly coupled or coupled through one or more other elements. An element may be coupled to an element through two or more other elements in a sequential manner or a non-sequential manner. The term "via" in reference to "via an element" may mean "through" or "by" an element. Coupled or connected or "associated with" may also mean elements not directly or indirectly attached, but that they "go together" in that one may function together with the other.

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, or ±10%. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, or ±10% of the definition; for example the term "substantially perpendicular" may mean the 90° perpendicular angle may mean "about 90°". The term "generally" may be equivalent to "substantially".

Features described in connection with one embodiment of the disclosure may be used in conjunction with other embodiments, even if not explicitly stated.

Embodiments of the disclosure include any and all parts and/or portions of the embodiments, claims, description and figures. Embodiments of the disclosure also include any and all combinations and/or sub-combinations of embodiments.

The invention claimed is:

1. An automatic faucet assembly, comprising a faucet body;

a faucet spout;

a temperature control assembly;

an electromechanical valve;

a presence sensor;

a power source; and a controller, wherein the presence sensor is configured to detect a presence and an absence of a person's hand at or near the faucet body and/or faucet spout, the controller is configured to receive a presence signal from the presence sensor indicating the presence of a person's hand at or near the faucet body and/or faucet spout, and is configured to receive an absence signal from the presence sensor indicating the absence of a person's hand at or near the faucet body and/or faucet spout, the controller is configured to instruct the electromechanical valve to open upon receiving the presence signal, and is configured to instruct the electromechanical valve to close upon receiving the absence signal, the faucet assembly is configured to dispense water when the electromechanical valve is open and is configured to not dispense water when the electromechanical valve is closed, a temperature of the dispensed water may be adjusted by operation of the temperature control actuator, the faucet assembly is configured to operate in a faucet mode selected from one or more of a spray mode, a stream mode, a water-savings mode, and a handwashing mode, and the faucet spout comprises a display surface configured to indicate the faucet mode.

2. The faucet assembly according to claim 1, wherein the presence sensor comprises a first capacitive sensor and a second capacitive sensor, the first capacitive sensor configured to detect a presence and an absence of a person's hand at or near the faucet body and/or faucet spout, and the second capacitive sensor configured to detect a presence and an absence of a person at or near a sink associated with the faucet assembly.

3. The faucet assembly according to claim 1, wherein the temperature control assembly is coupled to the faucet body, and comprises an off position configured to disallow the faucet assembly to dispense water.

4. The faucet assembly according to claim 1, wherein the display surface comprises a capacitive touch sensor configured to be operated for choosing the faucet mode.

5. The faucet assembly according to claim 1, wherein the display surface is configured to display a dispensed water temperature and a dispensed water time.

6. The faucet assembly according to claim 1, wherein the display surface comprises a first region and a second region, and one of the first region and the second region are configured to indicate the faucet mode.

7. The faucet assembly according to claim 5, wherein the display surface comprises a first region and a second region, and one of the first region and the second region is configured to indicate the dispensed water time, and the other of the first region and the second region is configured to indicate the dispensed water temperature.

8. The faucet assembly according to claim 7, wherein the first region is configured to indicate the dispensed water time and/or the faucet mode.

9. The faucet assembly according to claim 6, wherein the display surface comprises a first region, a second region, and a third region, and the third region is configured to display an icon indicating what is being displayed in the second region.

10. The faucet assembly according to claim 6, wherein the first region is configured to indicate the faucet mode and/or a dispensed water time, and the second region is configured to indicate the dispensed water temperature and/or a function a person is to perform in the faucet mode.

11. The faucet assembly according to claim 10, wherein the faucet mode is a handwashing mode, the first region is configured to indicate a water spray mode or a water stream mode, and the second region is configured to indicate the dispensed water temperature.

12. The faucet assembly according to claim 1, wherein in the water-savings mode, the electromechanical valve is configured to be positioned in a partially-opened position, and the flow rate of dispensed water is less than that when the electromechanical valve is in a fully-opened position.

13. The faucet assembly according to claim 1, wherein the faucet body and/or faucet spout comprise an electrically conductive material and is configured to be associated with an electric field, the faucet body, the controller, the electromechanical valve, and the power source are in electrical communication, the controller is configured to receive a presence signal from the faucet body and/or faucet spout indicating the presence of a person's hand in the electric field, and the controller is configured to receive an absence signal from the faucet body and/or faucet spout indicating the absence of a person's hand in the electric field.

14. An automatic faucet assembly, comprising a faucet body;

a faucet spout;

a temperature control assembly;

an electromechanical valve;

a presence sensor;

a power source; and a controller, wherein the presence sensor is configured to detect a presence and an absence of a person's hand at or near the faucet body and/or faucet spout, the controller is configured to receive a presence signal from the presence sensor indicating the presence of a person's hand at or near the faucet body and/or faucet spout, and is configured to receive an absence signal from the presence sensor indicating the absence of a person's hand at or near the faucet body and/or faucet spout, the controller is configured to instruct the electromechanical valve to open upon receiving the presence signal, and is configured to instruct the electromechanical valve to close upon receiving the absence signal, the faucet assembly is configured to dispense water when the electromechanical valve is open and is configured to not dispense water when the electromechanical valve is closed, a temperature of the dispensed water may be adjusted by operation of the temperature control actuator, the faucet spout comprises a display surface configured to indicate the dispensed water temperature and a dispensed water time, and the display surface comprises a capacitive touch sensor configured to be operated for choosing a faucet mode.

15. The faucet assembly according to claim 14, wherein the faucet mode is selected from one or more of a spray mode, a stream mode, a water-savings mode, and a handwashing mode.

16. The faucet assembly according to claim 14, wherein the display surface comprises a first region and a second region, and one of the first region and the second region are configured to indicate the faucet mode.

17. The faucet assembly according to claim 14, wherein the display surface comprises a first region and a second region, and one of the first region and the second region is configured to indicate the dispensed water time, and the other of the first region and the second region is configured to indicate the dispensed water temperature.

18. The faucet assembly according to claim 17, wherein the first region is configured to indicate the dispensed water time and/or the faucet mode.

19. The faucet assembly according to claim 16, wherein the display surface comprises a third region, the third region configured to display an icon indicating what is being displayed in the second region.

20. The faucet assembly according to claim 16, wherein the first region is configured to indicate a faucet mode and/or the dispensed water time, and the second region is configured to indicate the dispensed water temperature and/or a function a person is to perform in the faucet mode.

21. The faucet assembly according to claim 20, wherein the faucet mode is a handwashing mode, the first region is configured to indicate a water spray mode or a water stream mode, and the second region is configured to indicate the dispensed water temperature.

* * * * *